US005317954A

United States Patent [19]

Goans

[11] Patent Number: 5,317,954

[45] Date of Patent: * Jun. 7, 1994

[54] PRESSURE SWITCH ASSEMBLY

[76] Inventor: Kip B. Goans, 2576 Apollo Ave., Harvey, La. 70058

[ * ] Notice: The portion of the term of this patent subsequent to Oct. 13, 2009 has been disclaimed.

[21] Appl. No.: 863,048

[22] Filed: Apr. 3, 1992

Related U.S. Application Data

[63] Continuation of Ser. No. 644,193, Jan. 22, 1991.

[51] Int. Cl.[5] ..... F01B 31/00

[52] U.S. Cl. ..... 92/6 R; 92/59; 92/151; 200/82 R

[58] Field of Search ..... 92/6 R, 59, 150, 151; 200/82 R, 81.9 R

[56] References Cited

U.S. PATENT DOCUMENTS 676,251 6/1901 Hagman ..... 92/6 R
3,168,353 2/1965 Horowitz ..... 92/6 R
3,414,693 12/1968 Watson et al. ..... 200/82 R
3,464,741 9/1969 Falk ..... 200/82 R
3,677,005 7/1972 Estlick ..... 92/6 R
5,155,310 10/1992 Goans ..... 200/82 R

*Primary Examiner*—Thomas E. Denion
*Attorney, Agent, or Firm*—William C. Norvell, Jr.

[57] ABSTRACT

The present invention provides a pressure switch assembly for monitoring a source of fluid pressure. In one embodiment, the pressure switch assembly senses a variation of fluid pressure for actuation of a microswitch to open or close an electric circuit. In another embodiment, the pressure switch assembly provides a self contained cluster of piston members which are selectively interengagable to permit a variety of predetermined pressure ratings to act on the pressure switch assembly in response to a fluid pressure source, the cluster being manually reorganizable without adding or removing any parts to provide one valve assembly which may be responsive to a number of pre-selectable pressure ratings.

11 Claims, 3 Drawing Sheets

PRESSURE SWITCH ASSEMBLY

This is a continuation of co-pending U.S. patent application Ser. No. 644,193 filed on Jan. 22, 1991.

BACKGROUND OF THE INVENTION

(1) FIELD OF THE INVENTION

The invention relates to a pressure switch for sensing a control fluid pressure in response to variations of a monitored fluid pressure either above or below a desired normal value.

(2) BRIEF DESCRIPTION OF THE PRIOR ART

Pressure switches for sensing a control fluid pressure and for shifting a valve element in response thereto have been widely employed in the prior art. In many instances, the prior art has involved incorporation of a "spool" assembly which is manipulatable between positions in response to a pre-determined fluid pressure either of a liquid or a gas for shifting across a port or a passage to detect a pre-determined level in the sourced fluid pressure, or, alternatively, to actuate another mechanism.

In some instances, it may be desirable to sense a pre-determined level of a source of fluid pressure, and either provide an electronic indication of such sensed level or, alternatively, to activate an electronic signal for actuating an auxiliary mechanism by electric means, including a micro-switch or a fiber-optic-actuated mechanism which is, in turn, actuated by such micro-switch.

In many instances, it would be desirable to provide a single pressure switch assembly which may be responsive to a number of pre-selected levels of fluid pressure in the source or fluid conduit. In the past, any such pressure switch assembly would have to be enlarged, considerably, to incorporate a complex valving system which could be manipulated to provide one of several fluid levels for actuation. Such construction is cumbersome and expensive.

The present invention addresses the problems set forth above and provides a remedy therefore.

SUMMARY OF THE INVENTION

The present invention provides two unique features of a pressure switch assembly. In a preferred embodiment, these two features are combined into one assembly.

In one embodiment, a pressure switch is provided which is actuatable by a monitored fluid pressure. The pressure switch comprises a body having a central cylindrical chamber. A reduced diameter bore communicates with one end of the central chamber, and a spool is disposed in the reduced diameter bore. A bore is defined in the pressure switch transverse of the spool and communicates with the reduced diameter bore for receipt therethrough of a rod actuator. The rod actuator, in turn, has a profiled inner tip extending interiorly of the reduced diameter bore, and an outer tip for contact with a micro-switch to selectively open and close an electronic signal circuit in response to a sensed pressure level in the pressure switch. A mating surface is disposed on the spool and is companionly contoured relative to the profiled inner tip of the actuator rod.

First means are provided in the central cylindrical chamber for applying a bias against one end of the spool valve equal to a pre-determined pressure level sensed by the pressure switch. A second means in the body is in communication with the source of fluid pressure for overcoming the bias of the first means in response to a pressure level detected by the pressure switch in variation of the pre-determined fluid pressure level to manipulate the spool in a first direction and shift the rod actuator to one position to either open or close the circuit.

In another embodiment, the pressure switch comprises a body with a cylindrical chamber together with a reduced diameter bore communicating with one end of the chamber. A spool is disposed in the reduced diameter bore with first means in the central cylindrical chamber for applying a bias against the first end of the spool equal to a pre-determined pressure level sensed by the pressure switch. A piston chamber is disposed in the body in communication with the reduced diameter bore, with a cluster of piston members for shifting of the pressure switch in a first direction, with each member defining a face having a separate effective piston area thereacross corresponding to a respective pre-determined pressure rating of the monitored fluid and selectively arrangable within the body to permit only one of the pre-determined pressure ratings of the monitored fluid to act on the cluster and shift the spool in a first direction.

DESCRIPTION OF THE PREFERRED EMBODIMENTS

Figure 1:
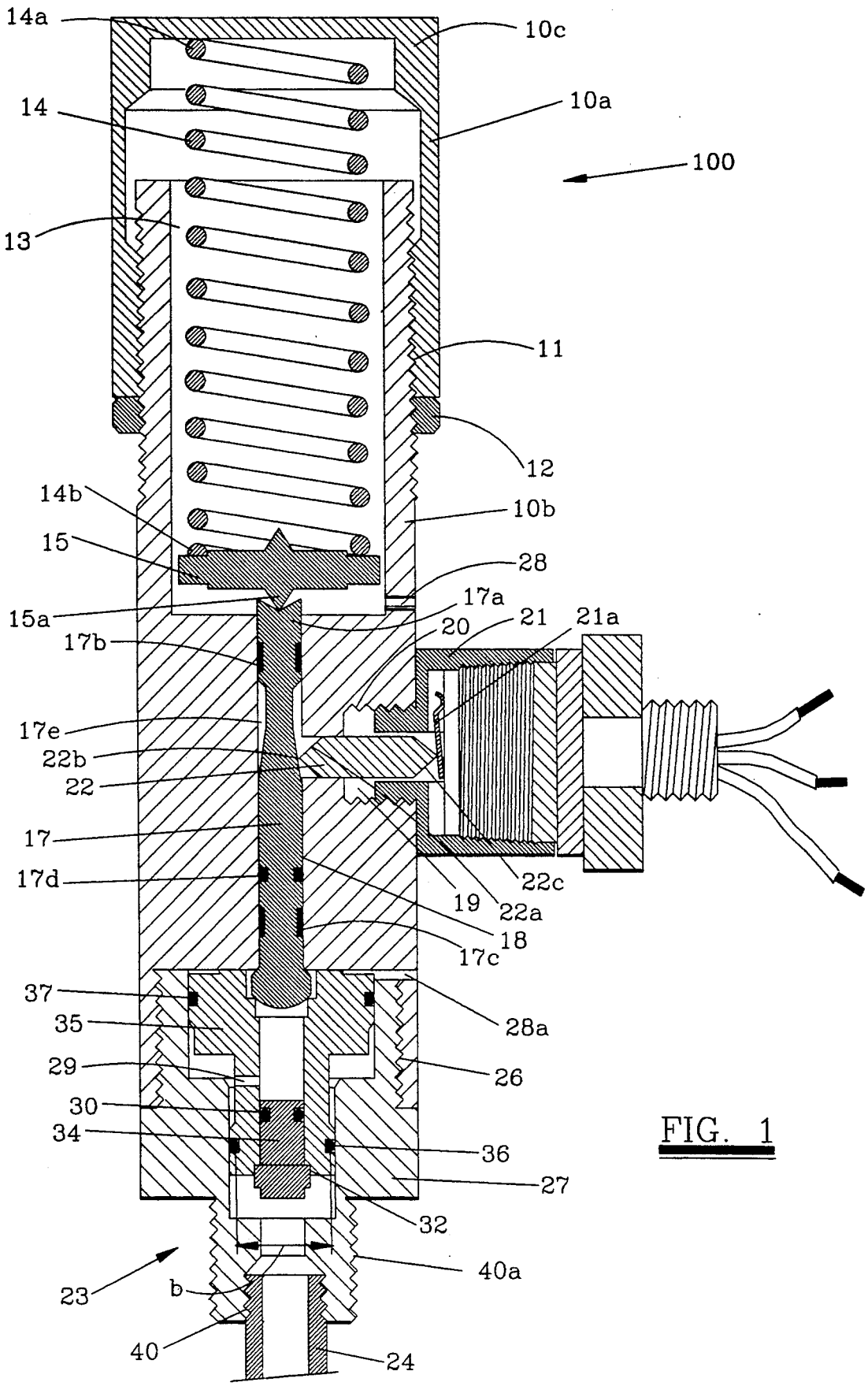
FIG. 1 is a longitudinal sectional view of the apparatus of the present invention with the micro-switch being shown closed with the monitored fluid pressure acting on the intermediate piston member.

Now, with reference to FIG. 1, there is shown a pressure switch assembly 100 having a body comprised of an upper cap 10*a* secured at threads 11 to an inner member 10*b*. A lock ring 12 is secured around the threads 11 to permit engagement of the body top 10*a* relative to the inner member 10*b* in a locked position. As will be appreciated, the length of the threads 11 on the body 10*b* are configured such that the top 10*a* may telescope relative to the inner member 10*b* along the threads 11 prior to insertion of the lock ring 12 to accommodate various sizes of a biasing member, such as spring 14 which is housed within the central cylindrical chamber 13 defined within the body member 10*b*.

The biasing member 14 has its upper end 14*a* snuggly secured against the innermost end of the cap 10*a* with the lower end 14*b* of the spring 14 seating upon the upper face of a spring retainer 15. The retainer 15 has a lower facing centered retainer point 15*a* which is matingly received within a retainer point groove 17*a* at the uppermost end of a spool 17. The spool 17 is elongated and is housed within a reduced diameter bore 18 in the inner member 10*b*. An upper elastomeric wear bearing 17*b* is circumferentially carried within a companion grooveway in the spool valve 17, while a similar lower wear bearing 17c is disposed around the lowermost end of the spool 17. An o-ring 17d is carried within a companion grooveway around the spool 17 intermediate the wear bearing 17b, 17c to prevent fluid communication thereacross.

The spool 17 also provides a profiled mating surface 17e just below the lower end of the upper bearing 17b for interengagement with the inner tip 22b of a rod actuator 22 received transversely of the spool 17 within a rod actuator bore 19. The bore 19 has threads 20 for receipt of the micro-switch housing 21. A profile 22a is defined on the rod actuator 22 and which forms the inner tip thereof. A similarly conformed outer tip 22c is defined on the outboard-most end of the rod actuator 22 and extends to a bias contact 21a on the micro-switch 21.

The lowermost end of the switch assembly 100 contains pilot cluster housing 27 secured to the inner member 10b by means of threads 26. The cluster housing 27 houses the second means in the body 23 and receives monitored fluid pressure conduit 24 secured to the housing 27 at its outboard end by means of threads 40. Alternatively, threads 40a may secure the pilot 100 directly to a source of monitored fluid pressure, in which instance a conduit 24 would not be secured to the threads 40.

Figure 2:
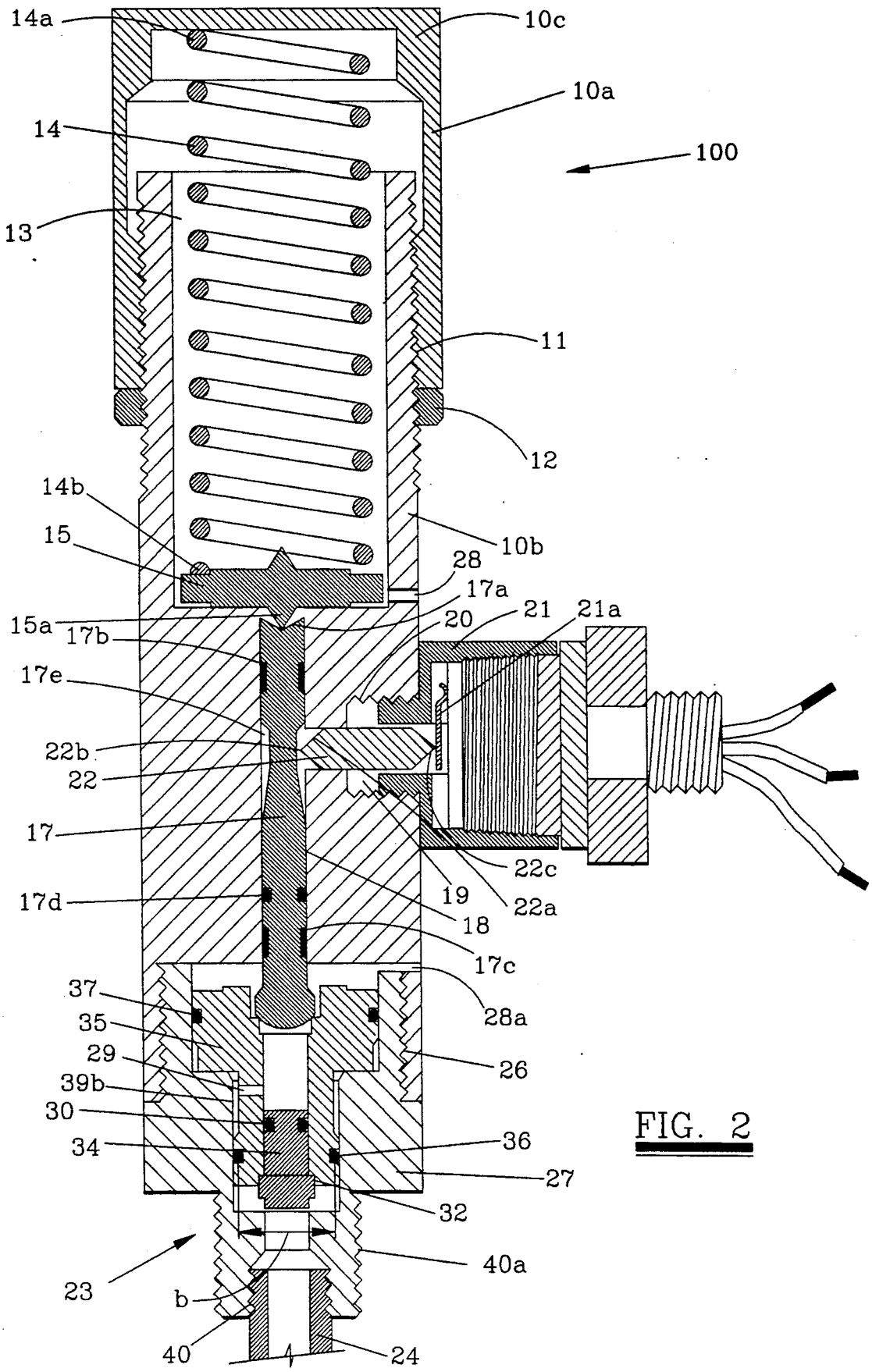
FIG. 2 is a view similar to that of FIG. but illustrating the pressure switch assembly in position with the micro-switch open.

As shown in FIGS. 1 and 2, the second means in the body 23, or cluster 23, is shown such that the cluster provides actuation in response to an intermediate effective piston area "b".

Figure 3:
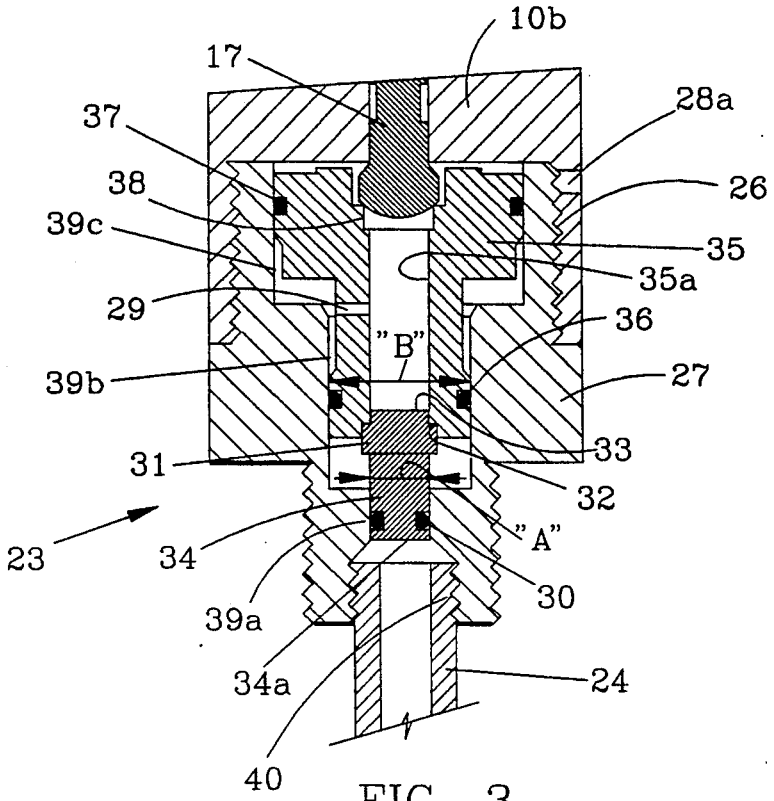
FIG. 3 is a view similar to that of FIGS. 1 and 2, but showing the detail portion of the apparatus which includes the smaller of the members of the piston cluster positioned in the cluster such that the fluid pressure acts on the smaller member.

Now looking at FIG. 3, the piston cluster is shown with the cluster housing 27 secured at threads 26. Vent 28 is disposed within the inner member 10b to permit venting of pressure as the piston cluster is moved inboardly.

The cluster housing 27 provides a series of sized cylinder bores 39a, 39b and 39c. Assuming that a cluster of piston members is to be adapted for use within the pressure switch assembly 100 such that one of three different, pre-determined pressure ratings may be utilized to actuate the pressure switch assembly 100, i.e., low, intermediate and high pressure ratings, the cluster shown in FIG. 3, and so arranged, will be provided. In such instances, the cluster will consist of the first cluster member 34 arranged relative to the second cluster member 35 as shown in FIG. 3.

A slot 32 is defined at the lowermost end around the second cluster member 35 for receipt of a companion "t" 31 at the uppermost end of the first cluster member 34, with the first cluster member 34 providing a circumferentially extending elastomeric o-ring seal element 30 at its outboard end 34 for receipt within the cylinder bore 39a.

The interengagement of the first cluster member 34 with the second cluster member 35 by mean of the "t" 31 within the slot 32 will carry the second cluster member 35 within the housing 27, as shown.

Interengagement between the spool 17 and the uppermost end of the second cluster member 35 will cause the spool 17 to move in response to detection of pressure across an effective piston area "a" defined across the o-ring 30 of the first cluster member 34, in the position as shown.

Figure 4:
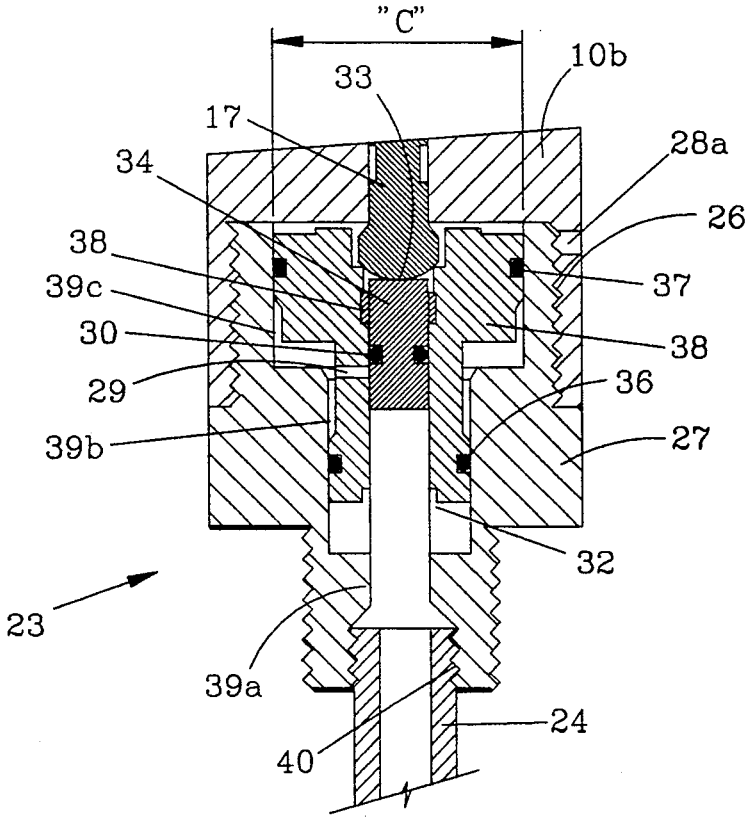
FIG. 4 is a view similar to that of FIG. 3 showing the larger of the members of the piston cluster being positioned within the apparatus such that the monitored fluid pressure acts on the larger piston area.

If the lower pre-determined pressure rating of the monitored source of fluid is to cause movement and activation of the spool 17, the cluster members 34 and 35 are arranged in the cluster housing 27, as in FIG. 4, such that the cluster housing 27 is removed from the inner member 10b by disengagement of the threads 26. Thereafter, the first and second cluster members 34, 35 may be disengaged from one another by disengaging the "t" 31 from within the slot 32. The first cluster member 34 then is positioned such that the end 34a of the member 34 is faced downwardly and positioned at the uppermost end of the passage 35 within the top of the second cluster member 35. A slot or groove 38 within the second cluster member 35 receives the "t" 31 and the o-ring 30 is now within the passage 35a. However, in this position, the o-ring 30 does not form an effective piston area, because of the provision of the large piston area "c" defined across the upperend of the second cluster member 35 by means of the circumferentially extending elastomeric seal element 37 which is sealingly engaged around the cylinder bore 39c.

A monitored fluid flow passage 29 is defined within the second cluster member 35 below the lowermost end of the first cluster member 34 and below the o-ring 30 to permit fluid communication to the lowermost face of the second cluster member 35 and actuation of pressure upon the piston area "c". In this position, the end 33 of the first cluster member 34 will contact and engage the lowermost face of the spool 17 to cause movement of such spool either upwardly, in the event of an increase in the monitored fluid pressure, or downwardly, in the event of a reduction in the pre-determined level of such fluid pressure.

In the event that a third of a selected number of predetermined levels of monitored fluid pressure is desired to actuate the pressure switch assembly 100, the cluster members 34 and 35 are arranged in the cluster housing 27, as shown in FIG. 2. In such instance, the first cluster member 34 is placed within the passage 35 such that the o-ring seal element 30 is within the passage 35 and the "t" 31 of the member 24 is within the slot 32. In this configuration, as shown in FIG. 2, the intermediate level of pressure has been selected as the designated level of pressure for actuation of the pressure switch assembly 100, and effective piston area "b" defined as the area across the elastomeric o-ring seal element 36 detects the level of the monitored fluid pressure and the piston area "b" will extend from the interior of the cylinder bore 39b thereacross.

OPERATION

In order to operate the pressure switch assembly 100, the selected bias force for movement of the spool 17 in one direction is determined by picking the appropriate spring member 14 and placing same within the body 10b. A micro-switch 21 is threadedly secured into the inner member 10b at threads 20 such that contact 21a biases the rod actuator 22 inwardly upon engagement with the outer tip 22c.

Assuming that the intermediate pressure level of the sourced fluid pressure is desired for actuation of the pressure switch assembly 100, the cluster of members 34 and 35 is arranged as in FIG. 2. If the lower or higher of the pressure ratings is desired, the clusters 34, 35 may be configured as shown in FIG. 3 or FIG. 4, with vent 28a disposed therein.

Upon selection of the appropriate cluster configuration, the members 34 and 35 are arranged within the cluster housing 27 and the housing 27 is secured to the inner member 10b by manipulation of the threads 26, with the pressure switch assembly 100 either being secured to a source of fluid pressure at threads 40a or, alternatively, a fluid pressure conduit 24 is inserted by means of threads 40 in the cluster housing 27.

Assuming that an increase in sourced fluid pressure is the force which causes the pressure switch assembly 100 to manipulate the micro-switch 21, the level of pressure will be detected across effective piston area "b" and spool 17 will be moved upwardly, with atmospheric pressure being vented through vent port 28. Now, the mating surface 17*e* along the spool 17 will shift the inner tip 22 laterally until the bias through contact 21*a* is overcome and the contact 21*a* engages the end of either a positive or negative element in the micro-switch 21, in conventional fashion. The micro-switch 21, in turn, causes activation of an audible and/or visible signal indicating the existence of the pre-determined pressure level or, alternatively, actuates an auxiliary device, such as a secondary valve, or the like.

It will be appreciated that the fluid contemplated for use with the pilot 100 may either be a liquid or a gas. It will be further appreciated that the micro-switch 21 may be either a true electric switch, or may be a fiber-optic element, laser, or the like. In any event, by utilization of the phrase "micro-switch" in this specification and claims, any type of device which is activated by electric or light or optic signal source is contemplated.

It will be further appreciated that the biasing member 14 need not be a spring, but may, in fact, be another source, or level, of the sourced fluid, or some other fluid, either in liquid or gaseous format.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve assembly responsive to a first source of fluid, comprising:

(1) a body;

(2) a spool assembly within said body moveable between first and second positions in response to a variation of pressure within said body of said first source of fluid; and (3) a cluster of piston members for shifting of said spool assembly in a first direction, each of said piston members defining a face having a separate effective piston area thereacross corresponding to a respective pre-determined pressure rating of said first source of fluid, and selectively arrangeable within said body to permit only one of said pre-determined pressure ratings of said first source of fluid to act on said cluster and shift said spool assembly in a first direction to one of said first and second positions.

2. The assembly of claim 1 wherein first and second piston members form said cluster of piston members and said piston members define a low, and intermediate, and a high effective piston area, one of said cluster members forming two of said low, intermediate and high effective piston areas thereacross.

3. The assembly of claim 1 wherein a piston chamber housing is provided within said body for receipt of said cluster of piston members, said piston chamber housing being selectively engageable with and removeable with said body for manual realignment of said cluster piston members.

4. The valve assembly of claim 1 wherein first and second piston members form said cluster, said second piston member being housed within said first piston member, said first piston member having first and second piston areas thereacross, said second piston member having a third piston area thereacross.

5. The valve assembly of claim 4 wherein said first member defines a piston member chamber therein and an opening at each end for selective receipt of said second piston member.

6. The valve assembly of claim 5 further including: a slot disposed around one end of said first piston member and a "T" neck defined on said second piston member formating receipt with said slot.

7. The assembly of claim 5 further comprising: a groove for companion receipt of an end of said second piston member, said end of said second piston member profiled for snug receipt within said end of said first piston member.

8. The valve assembly of claim 4: said second piston member having first and second ends, one of said first and second ends of said second piston member having means for locking engagement within an end of the first piston member, the other of said first and second ends of said second piston member providing sealing means for sealing engagement relative to said piston member chamber.

9. A pressure switch assembly activatable by monitored fluid pressure, comprising:

(1) a body having a central cylindrical chamber;

(2) a reduced diameter bore communicating with one end of said central chamber;

(3) a spool disposed in said reduced diameter bore;

(4) a bore defined in said body transverse of said spool and communicating with said reduced diameter bore for receipt therethrough of:

(5) a rod actuator having a profiled inner tip extending interiorly of the reduced diameter bore, and an outer tip for contact with means to selectively open and close a signal source in response to a sensed pressure level in said pilot;

(6) a mating surface disposed on said spool companionly contoured relative to the profiled inner tip of said rod actuator;

(7) first means in said central cylindrical chamber for applying a bias against one end of said spool equal to a pre-determined pressure level sensed by said pressure switch assembly; and (8) second means in said pressure switch assembly in communication with a source of fluid pressure for overcoming the bias of said first means in response to a pressure level detected by said pressure switch in variation of said pre-determined fluid pressure level to manipulate said spool in a first direction and shift said rod actuator to one position to open or close said circuit.

10. The pressure switch assembly of claim 9 wherein said profiled inner tip of said rod actuator is arrow-shaped and the mating surface on said spool defines a groove for receipt of said rod actuator inner tip, said groove being circumferentially subscribed around said spool and having one end defining a first diameter slopingly extending to the other end having a second enlarged diameter, said rod actuator when said inner tip is disposed at one end of said groove opening said circuit, said rod actuator when said inner tip is disposed at the other end of said groove closing said circuit.

11. The pressure switch assembly of claim 9 wherein the mating surface on said spool defines a groove for receipt of said rod actuator inner tip, said groove being circumferentially subscribed around said spool and having one end defining a first diameter slopingly extending to the other end having a second enlarged diameter, said rod actuator, when said inner tip is disposed at one end of said groove, opening said circuit, said rod actuator, when said inner tip is disposed at the other end of said groove, closing said circuit.

* * * * *